United States Patent [19]

Silvenis et al.

[11] Patent Number: 4,741,459

[45] Date of Patent: May 3, 1988

[54] COMBINED CLOSURE AND MEASURING DEVICE

[75] Inventors: Scott A. Silvenis, Mauldin; William J. Britt, Greenville, both of S.C.

[73] Assignee: The Dow Chemical Company, Midland, Mich.

[21] Appl. No.: 842,617

[22] Filed: Mar. 21, 1986

[51] Int. Cl.[4] ..... B67D 5/00

[52] U.S. Cl. ..... 222/23; 141/381; 222/478; 222/538; 222/548; 222/571

[58] Field of Search ..... 222/571, 567, 479, 485, 222/488, 482, 484, 565, 23, 29, 502, 519, 520, 538, 548, 478; 141/381; 220/23.83, 23.86

[56] References Cited

U.S. PATENT DOCUMENTS

| | | | |
|---|---|---|---|
| 1,270,692 | 6/1918 | Button | 222/484 |
| 1,992,513 | 2/1935 | Solomon | 222/478 |
| 2,061,085 | 11/1936 | Wheaton | 141/381 |
| 2,108,692 | 2/1938 | Pieck | 141/381 |
| 2,815,155 | 12/1957 | Roche | 222/478 |
| 4,222,504 | 9/1980 | Ackerman | 222/571 X |
| 4,566,509 | 1/1986 | Szajna | 141/381 |

*Primary Examiner*—Robert J. Spar
*Assistant Examiner*—P. McCoy Smith

[57] ABSTRACT

A dispensing apparatus is disclosed having a hollow wall member closed at one end with a dispensing opening at the other end. A ledge is mounted within the hollow having an aperture therethrough to permit precise pouring through the aperture but with the opening otherwise permitting dispensing of large amounts. Indicia is provided within the hollow to measure a predetermined amount of material, particularly the amount required for a washload within an automatic washing machine. The dispensing apparatus additionally operates as a closure for a container, preferably of a laundry product and has a skirt for matingly engaging a container opening and closing same.

9 Claims, 3 Drawing Sheets

FIG. 3A
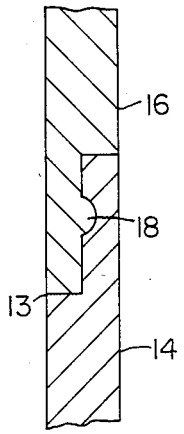
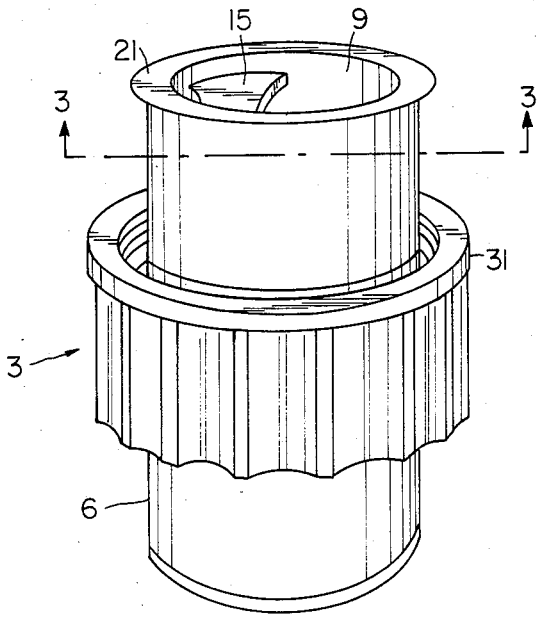
FIG. 4

COMBINED CLOSURE AND MEASURING DEVICE

BACKGROUND OF THE INVENTION

This invention relates generally to the art of dispensing and more particularly to the art of a combined closure and measuring device for utilization with liquid laundry products or any use-diluted product.

Many devices have been utilized for the dispensing of laundry products. In particular, measuring cups have been frequently utilized with both powdered and liquid products to assure an appropriate amount of laundering product within the washing machine or other device. As used within this application the term "laundry product" is meant to include such diverse laundry components as detergents, pretreatment stain removers, fabric softeners, bleaches and the like.

There is disclosed in U.S. Pat. No. 4,550,862 a measuring device for use with a liquid laundry product having a drain-back feature such that when use of the device is completed any extra product will drain back into the original container. The device additionally is utilized as a product closure.

U.S. Pat. No. 3,390,822 discloses an additional closure which is also utilized as a measuring device for dispensing powdered products which are hygroscopic in nature.

Various devices have been devised to ease the pouring of liquid products so as to eliminate the dripping which occurs upon completion of the pouring of a desired amount. Such devices are exemplified by U.S. Pat. Nos. 3,549,062 and 3,833,150.

While many devices have been devised for measuring and pouring various products, including laundry products, no single product has been envisioned which eases the problems associated with the need to have varied dispensing of both small and large amounts.

SUMMARY OF THE INVENTION

It is thus an object of this invention to provide a novel dispenser for liquid laundry products.

It is an additional object of this invention to provide a novel dispensing device which is also a container closure.

It is a further and more particular object of this invention to provide a dispensing device which is adaptable for dispensing both small and large amounts of product.

These as well as other objects are accomplished by a dispensing apparatus comprising a hollow walled member closed at one end with a dispensing opening at the other end. A ledge is mounted within the hollow thereof with an aperture therethrough to permit precise pouring through the aperture but with the opening otherwise permitting dispensing of large amounts. Indicia is provided within the hollow to measure a predetermined amount of material, particularly the amount required for a washload within an automatic washing machine. The apparatus additionally is a closure for a container of laundry product and a skirt is provided about the hollow cylindrical member with engaging means thereon to matingly engage a container opening for closing same.

BRIEF DESCRIPTION OF THE DRAWINGS

FIGS. 3 and 3A of the drawings are enlarged inverted cross-sectional views of a portion of FIGS. 2 and 4.

FIG. 4 of the drawings illustrates a perspective view of the closure of FIGS. 1 and 2.

DETAILED DESCRIPTION

In accordance with this invention it has been found that a dispensing apparatus may be provided for a laundry product which is also a closure for a container of such product. Additionally, this invention provides a dispensing apparatus which permits the accurate dispensing of a small amount of laundry product such as might be required for spot treatment of stains and the like on soiled fabrics. The dispenser, however, is additionally useful for dispensing larger amounts of laundry product such as that required for use with a complete washload within an automatic washing machine. Various other advantages and features of the invention will become apparent from a reading of the following description given with reference to the various figures of drawing.

Figure 1:
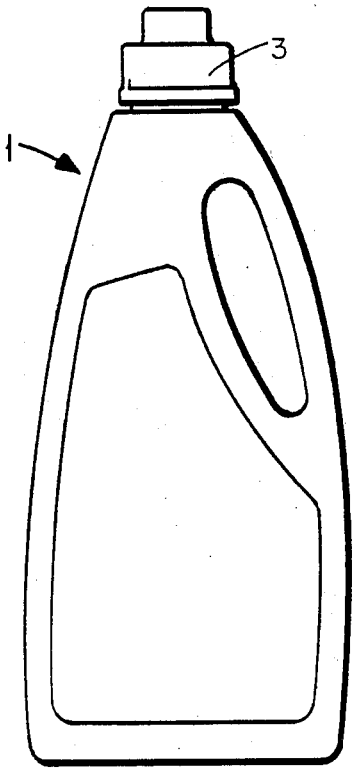
FIG. 1 of the drawings illustrates in perspective view a container with a closure thereon in accordance with this invention.
Figure 2:
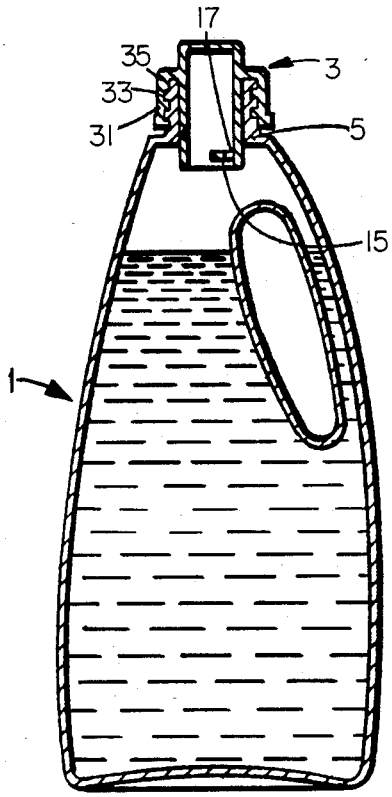
FIG. 2 of the drawings is a cross-section view through the midplane of FIG. 1.

FIG. 1 of the drawings illustrates a container 1 of laundry product having a closure 3 thereon. The closure 3 embodies the dispenser of this invention, and its relationship with container 1 is best illustrated in FIG. 2 which is a cross-section through the midplane of FIG. 1. Referring to FIG. 2 it can be seen that the closure 3 engages neck 5 of container 1 and effectively closes same. To better describe closure 3 and its dispensing characteristics, closure and dispenser 3 are illustrated in cross-section view in its inverted state in FIGS. 3 and 4 of the drawings.

Figure 3:
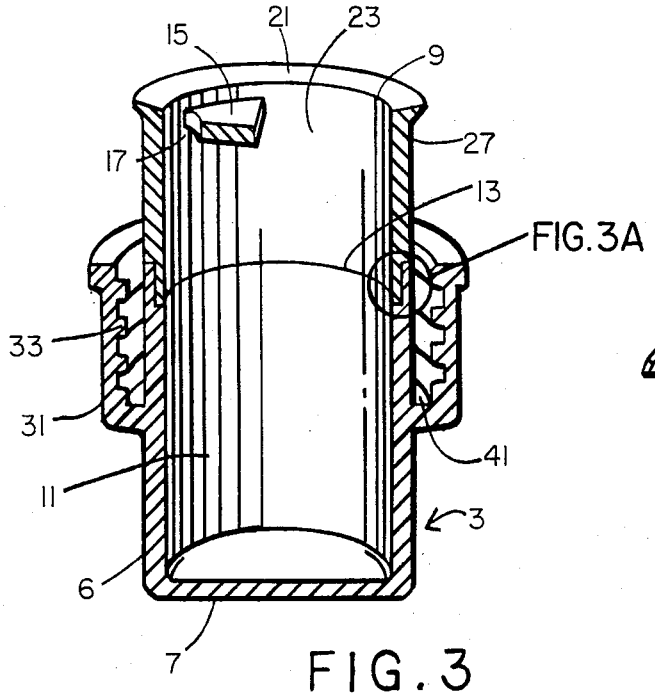

As illustrated in FIGS. 3 and 3A it can be seen that the dispenser and closure 3, which henceforth will be referred to as a dispenser or dispensing apparatus, is formed of a hollow walled member 6, preferably cylindrical, having a closure 7 at one end thereof and a dispensing opening 9 at the other end thereof. Within the hollow 11 of hollow cylindrical member 6 is indicia 13 to indicate a predetermined measurement between the indicia and the closed end 7. It is thus contemplated that the contents of container 1 would be poured into dispenser 3 up to indicia 13 for dispensing same into an automatic washing machine.

The indicia 13 may preferably take the form of a part-line between the two components as illustrated in FIGS. 3 and 3A for the purpose of forming dispenser 3. As best illustrated in FIG. 3 of the drawings, indicia 13 is formed as a part-line between lower section 14 and upper section 16 wherein the two are joined together by a snap pressure fit as illustrated. The indicia 13, however, may be formed by other methods of closure of the components such as chemical or physical bonding. As illustrated in FIG. 3A, snap pressure fit about bead 18 permits upper section 16 to rotate with respect to lower section 14. This structure possesses the advantage of permitting precise location of the upper section during dispensing of the product from dispenser 3. It is also apparent that indicia 13 may be enhanced by having the upper and lower surfaces join in a non-flush manner (not illustrated).

In order to facilitate the dispensing of a small amount of laundry product such as might be required for a pretreatment of spots on soiled products, a ledge 15 is provided having an aperture 17 therethrough to permit pouring of a small amount of product from dispenser 3 through open end 9. Open end 9 preferably has a droplet retaining surface 21 which obliquely joins the inner surface 23 to promote draingage of droplets toward closed end 7. In a similar fashion, upper surface of ledge 15 also obliquely joins surface 23 to promote drainage from that surface toward closed end 7 as well.

Figure 5:
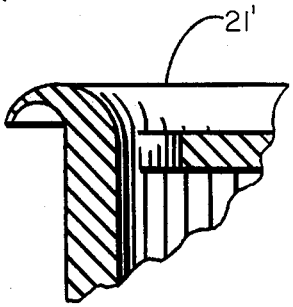
FIGS. 5 and 5A of the drawings illustrate variations of the cross-sectional view of FIG. 3.
Figure 5A:
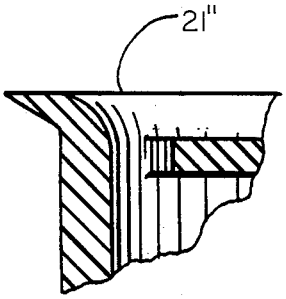

Open end 9 may have its surface 21 sharply join outer surface 27 as illustrated in FIG. 3 for the purpose of prohibiting drops from inadvertently dropping from the container or running down outer surface 27. Alternative anti-drip measures are illustrated in FIG. 5 and FIG. 5A wherein alternative surfaces 21' or 21'' illustrate non-drip configurations which promote drainage toward closed end 7.

It is seen that engaging means in the form of a skirt 31 is concentrically located about hollow cylindrical member 5 and provided with threads 33 on the interior thereof to matingly engage with complementary threads 35 contained in the neck 5 of container 1.

Skirt 31 may be provided with means such as bead or flexible claw 41 to seal with the neck 5 of container 1. Such would be advantageous to discourage leakage from the container during shipment and storage of containers within the commercial distribution network.

Figure 6:
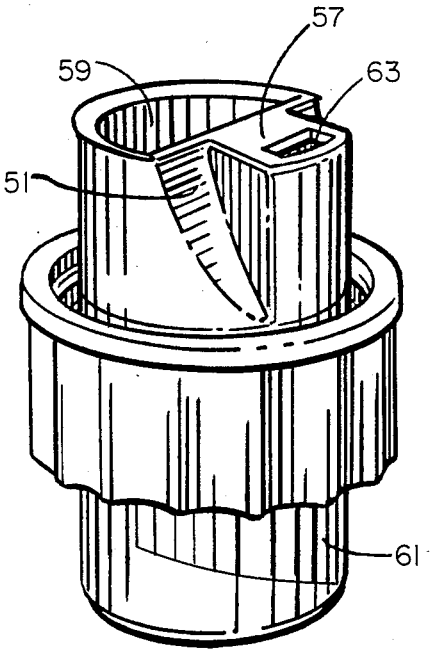
FIG. 6 is a perspective view of an additional embodiment in accordance with this invention.

FIG. 6 of the drawings illustrates an alternative embodiment of a somewhat different configuration wherein the hollow walled member is truncated as at 51 to provide a ledge member 57 which is generally coincidental with opening 59 of the overall hollow walled member 61. Ledge 57 thus defines an aperture 63 therethrough for pretreatment quantities while the remainder of opening 59 is available for dispensing large quantities into an automatic washing machine.

It is thus seen that the dispenser of this invention also provides a product closure for laundry products as well as providing a dispenser which is capable of dispensing small accurate amounts as well as large amounts for large loads within an automatic washing machine. As many variations will become apparent from a reading of the foregoing description which is exemplary in nature, such variations are included within the spirit and scope of the following appended claims.

What is claimed is:

1. A dispensing apparatus comprising:

a hollow cylindrical member, said cylindrical member being closed at one end and open at the other end thereof and formed of separate upper and lower sections;

indicia within the hollow of said hollow cylindrical member designating a predetermined volume between said indicia and said closed end said indicia being formed by the joinder of said upper and lower sections;

a ledge within said hollow, said ledge defining an aperture therethrough for preciser pouring through said aperture and said open end;

a skirt about said hollow cylindrical member having threads therein for engaging mating complementary threads on a container for closing said container.

2. The apparatus according to claim 1 wherein said hollow cylindrical member has an inside wall and an outside wall which are bridged by a droplet retaining surface at said open end.

3. The apparatus according to claim 2 wherein said droplet retaining surface obliquely intersects said inside wall to promote drainage of droplets toward said closed end.

4. The apparatus according to claim 1 wherein said ledge partially covers said open end.

5. The apparatus according to claim 3 wherein said ledge has an upper surface which obliquely intersects said inside wall to promote drainage thereof toward said closed end.

6. The apparatus according to claim 1 wherein said skirt contains means to seal with a necked opening of said container.

7. A dispensing apparatus comprising:

a hollow walled member formed of separate upper and lower sections with the joinder thereof forming indicia indicitive of a predetermined volume within said dispensing apparatus;

a ledge within the hollow of said hollow walled member, said ledge defining an aperture therethrough for precise pouring through said aperture and an open end of said hollow walled member;

engaging means on the exterior of said hollow walled member for engaging and closing a container.

8. The dispensing apparatus according to claim 7 wherein said upper and lower sections are rotatable with respect to one another.

9. A dispensing apparatus comprising:

a hollow walled member formed of upper and lower sections rotatable with respect to one another and forming indicia at the joinder thereof;

a ledge within the hollow of said hollow walled member, said ledge defining an aperture therethrough for precise pouring through said aperture at an open end of said hollow walled member;

engaging means on the exterior of said hollow walled member for engaging and closing a container;

said indicia designating a predetermined volume within said hollow walled member.

* * * * *